US007394208B2

(12) United States Patent
Ribarich et al.

(10) Patent No.: US 7,394,208 B2
(45) Date of Patent: Jul. 1, 2008

(54) SIMPLIFIED ELECTRONIC BALLAST CIRCUIT AND METHOD OF OPERATION

(75) Inventors: Thomas J Ribarich, Laguna Beach, CA (US); Zan Huang, Torrance, CA (US)

(73) Assignee: International Rectifier Corporation, El Segundo, CA (US)

( * ) Notice: Subject to any disclaimer, the term of this patent is extended or adjusted under 35 U.S.C. 154(b) by 0 days.

(21) Appl. No.: 11/136,915

(22) Filed: May 24, 2005

(65) Prior Publication Data

US 2005/0264240 A1 Dec. 1, 2005

Related U.S. Application Data

(60) Provisional application No. 60/574,407, filed on May 25, 2004.

(51) Int. Cl.
*H05B 37/02* (2006.01)

(52) U.S. Cl. ..... 315/219; 315/291

(58) Field of Classification Search ..... 315/209 R, 315/219, 224, 209 CD, 246, 247, 276, 283, 315/287, 291, 307, 308
See application file for complete search history.

(56) References Cited

U.S. PATENT DOCUMENTS

| | | | | |
|---|---|---|---|---|
| 3,700,956 | A * | 10/1972 | Cluett | 315/101 |
| 5,028,846 | A * | 7/1991 | Lesea | 315/219 |
| 5,757,626 | A * | 5/1998 | Jovanovic et al. | 363/21.04 |
| 6,108,222 | A * | 8/2000 | Liang | 363/48 |
| 6,465,990 | B2 * | 10/2002 | Acatrinei et al. | 323/222 |

* cited by examiner

*Primary Examiner*—Thuy Vinh Tran
(74) *Attorney, Agent, or Firm*—Ostrolenk, Faber, Gerb & Soffen, LLP

(57) ABSTRACT

The present invention relates to an electronic ballast for driving a fluorescent lamp or the like, and more particularly to a new topology ballast that has only one switch in its oscillating part. The new ballast is an improvement over the conventional half-bridge structure, having a reduced number and size of key components, as compared to conventional designs.

18 Claims, 3 Drawing Sheets

SIMPLIFIED ELECTRONIC BALLAST CIRCUIT AND METHOD OF OPERATION

CROSS REFERENCE TO A RELATED APPLICATION

The present application is based upon and claims priority of Provisional Application Ser. No. 60/574,407 filed May 25, 2004, incorporated by reference in its entirety.

BACKGROUND OF THE INVENTION

The present invention relates to an electronic ballast for driving a fluorescent lamp or the like, and more particularly to a new topology ballast that has only one switch in its oscillating part.

FIG. 1 is a simplified schematic diagram of a conventional ballast circuit. As shown, the PFC (power factor correction) stage receives and rectifies AC power with power factor correction. Two switches M1 and M2, which are power MOS devices in this example, are connected in series to form a half bridge and are so controlled as to apply an oscillating voltage to a LC resonant tank circuit to drive the lamp.

It would be desirable to improve upon the conventional half-bridge structure, by reducing the number and size of key components, as compared to conventional designs.

SUMMARY OF THE INVENTION

A first aspect of the invention relates to an electronic ballast circuit for delivering power to a load circuit including a fluorescent lamp, comprising a DC source; a first LC tank circuit comprising a first inductor and a first capacitor connected in series across the DC source; and a single semiconductor switch connected in parallel with the first capacitor; the first inductor being inductively coupled to the load circuit for delivering power to the fluorescent lamp. The load circuit comprises a second LC tank circuit comprising a second inductor inductively coupled to the first inductor and a second capacitor connected in parallel with the second inductor; and further comprises the fluorescent lamp. The first and second inductors preferably form a transformer, providing isolation of the load circuit. Power factor correction may be included in the DC supply. A control circuit is connected to the semiconductor switch for driving the switch at variable frequencies for operating the lamp in at least one of preheat, ignition, and running modes.

According to a preferred mode of operating the circuit, the control circuit turns on the switch at a time when current in the first inductor is increasing, and turns off the switch near a zero-crossing of said first inductor current. Also preferably, the control circuit turns the switch off and on at times when the voltage on the first capacitor is near zero. The control circuit may further include sensing circuits for sensing current in the first inductor, and/or voltage on the first capacitor.

Other features and advantages of the present invention will become apparent from the following description of embodiments of invention which refers to the accompanying drawings.

DETAILED DESCRIPTION OF EMBODIMENTS OF THE INVENTION

Figure 1:
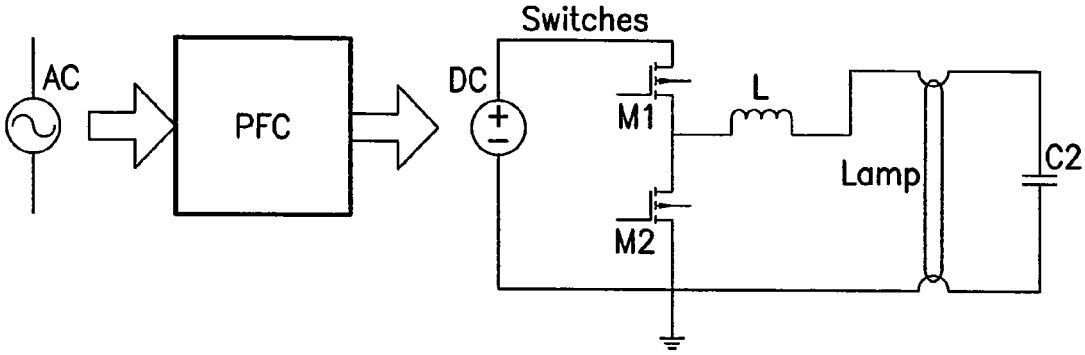
Figure 1 Prior Art
FIG. 1 is a simplified schematic diagram of a conventional ballast circuit.
Figure 2:
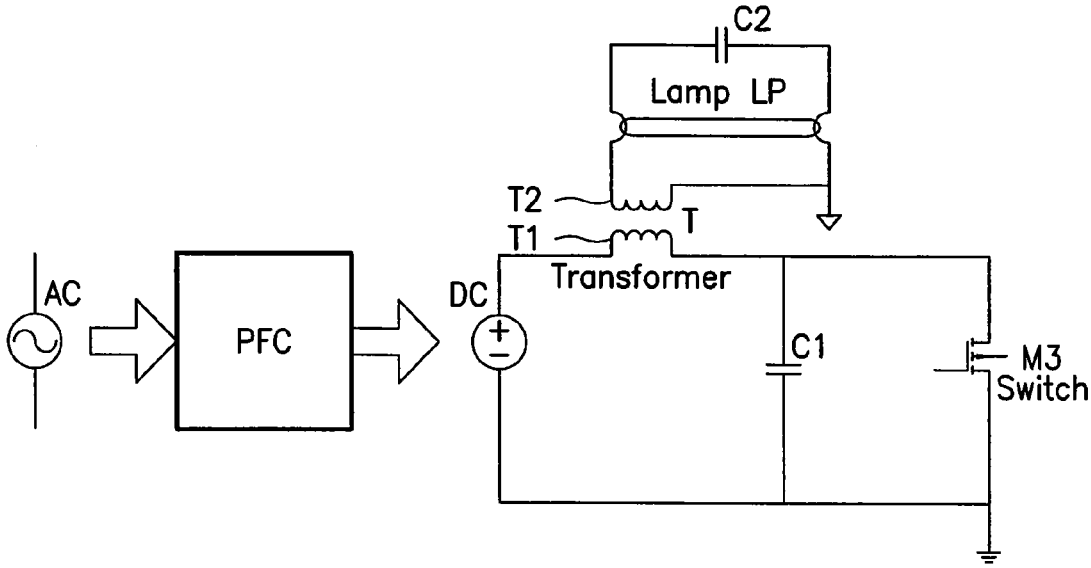
FIG. 2 is a simplified schematic diagram showing the topology of the one-switch ballast control circuit.

FIG. 2 is a simplified schematic diagram showing the topology of the one-switch ballast control circuit. The inductor L in the circuit of FIG. 1 has been replaced by a transformer T and a capacitor C1. By using the transformer and the additional capacitor, only one switch is sufficient in this circuit, which simplifies the structure and lowers the cost. A single switch M3, which may for example be a power MOS device, is connected in parallel with the capacitor C1 and is controllable, by a control circuit shown schematically as U6 in FIG. 4, so as to selectively ground the connection point between T and C1.

The rectified DC is applied to the series circuit comprising the capacitor C1 and the primary T1 of the transformer T. The secondary T2 of the transformer T and the capacitor C2 are both connected in parallel with the lamp LP.

Figure 3:
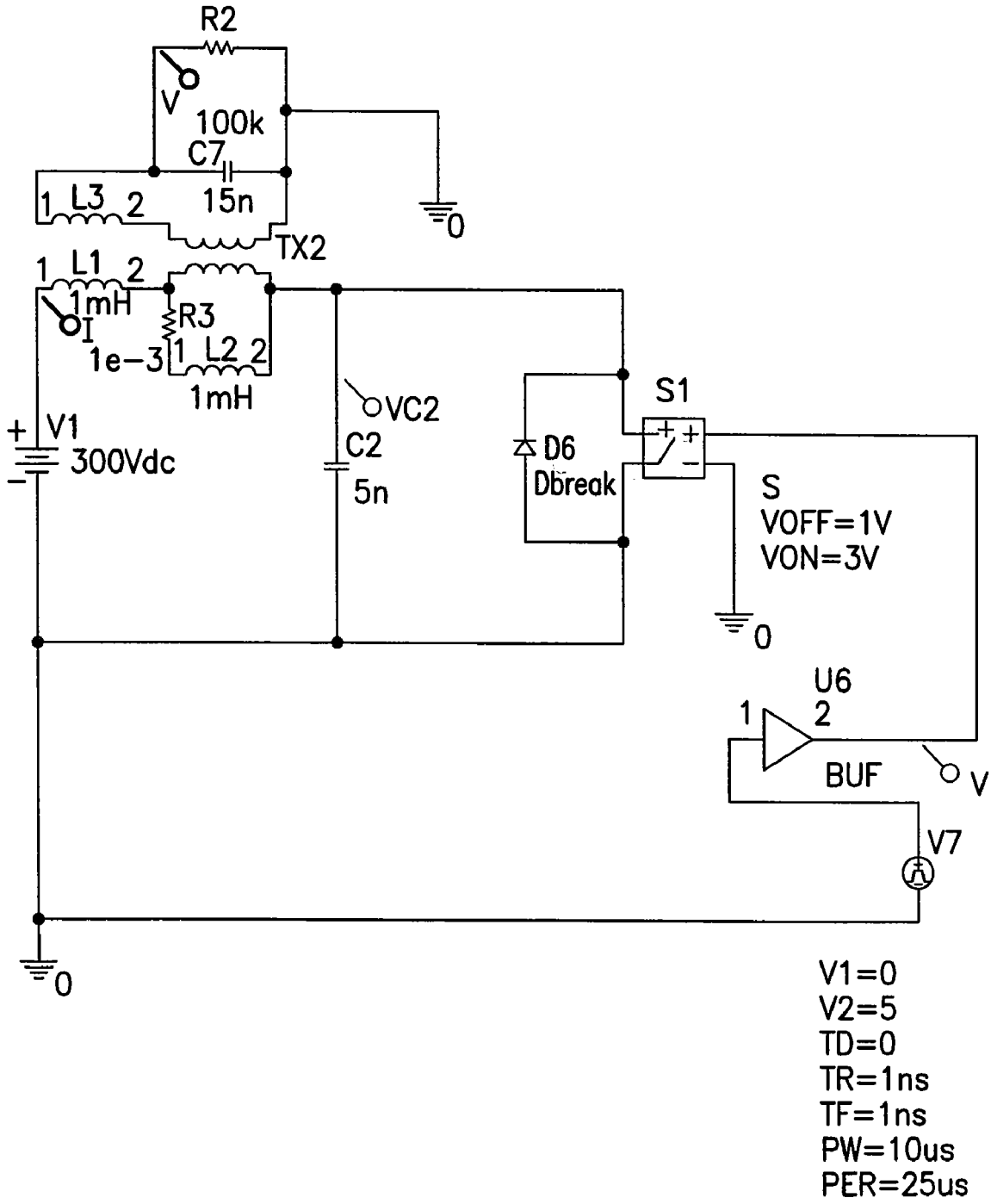
FIG. 3 is a detailed schematic diagram corresponding to the circuit shown in FIG. 2.

Simulation Analysis:

A simulation was done using the circuit shown in FIG. 3. L1, L2, L3, R3 and TX2 (which is an ideal transformer) form the equivalent circuit of the transformer T in FIG. 2, which has high leakage inductance.

When the switch S1 is turned on, the input voltage V1 is applied to the inductors L1 and L2, and the current I increases linearly. When the switch S1 is turned off, the input voltage is applied to the inductors L1 and L2 and the capacitor C2, which together form a resonant tank. The current I then increases sinusoidally, as C2 will be charged up sinusoidally. After VC2 reaches its peak, the current I drops back down sinusoidally to zero. The current now flows back to the input source and the body diode D6 of the switch conducts. The inductor current I is then charged up linearly again. The switch is turned on again while the inductor current is increasing. Even if the switch is turned on before the current I goes positive, it won't affect the charging.

Figure 4:
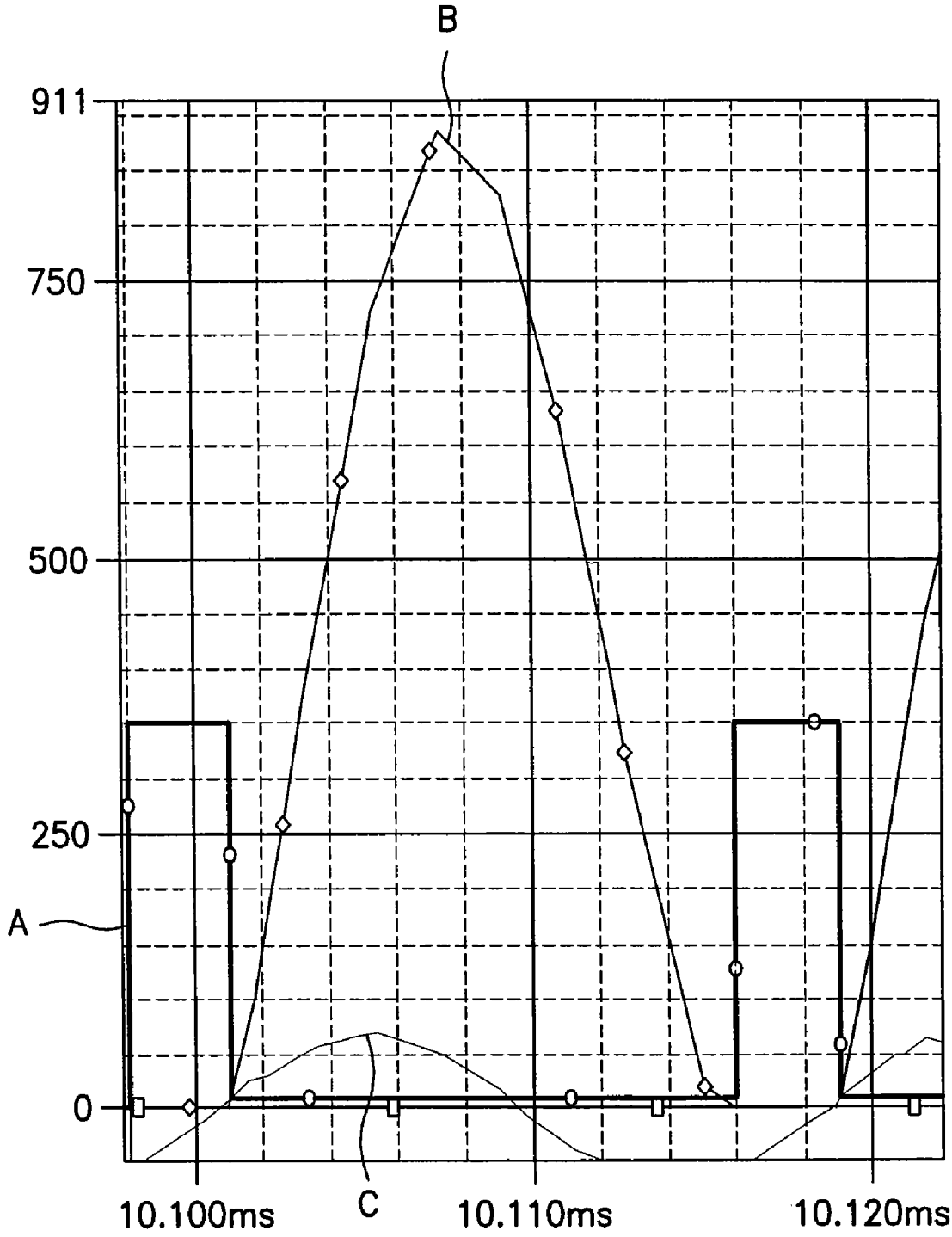
FIG. 4 is a graph showing measurements taken in the circuit of FIG. 3.

As shown in FIG. 4, the square waveform A is the switching signal; the half sinusoidal waveform B is the capacitor voltage VC2, and the sinusoidal waveform C is the inductor current I.

By driving the circuit in this fashion, the switch is always turned on and off at a time when the capacitor voltage is near zero, which provides zero voltage switching. Also, by providing a circuit to sense the inductor current, the switch can be controlled to be turned off when the inductor current is close to zero, which provides zero current switching as well. These soft switching operations will guarantee that the MOSFET or other semiconductor power switching device will run cool and with high efficiency.

The disclosed control and sensing circuits can be combined in a single integrated circuit using known techniques.

Theoretical Analysis and Equations:

The theoretical analysis is done step by step and the three most important operating modes for the lamp, namely the preheat, ignition and run modes, are discussed below:

1. Without Secondary Side

When switch is turned off $$V_c = x\sin(\omega t + a) + V_{DC},\ V_c \geq 0 \text{ (Sinusoidal waveform with DC offset)}$$

$$I_L = y\cos(\omega t + a) \text{ (Sinusoidal waveform without DC offset for inductor rule)}$$

$$x\sin a + V_{DC} = 0 \text{ (Starting point of capacitor voltage)}$$

$$y\cos a = \frac{V_{DC}}{L} \cdot \frac{T_{ON}}{2} \text{ (Starting point of inductor current)}$$

$$\omega = \frac{1}{\sqrt{LC}} \Rightarrow x = \sqrt{\frac{L}{C}}\, y \left(\text{From } I_c = I_L \text{ and } I_c = C\frac{dv}{dt}\right) \Rightarrow \sqrt{\frac{L}{C}} \tan a = -\frac{2L}{T_{on}} \Rightarrow a = a\tan\left(-\frac{2L}{T_{ON}} \cdot \sqrt{\frac{C}{L}}\right) = a\tan\left(-\frac{2}{T_{on}} \cdot \sqrt{LC}\right)$$

(Equation shows the on time will change phase angle α, the smaller on time leading to an angle closer to −90 degree)

$$\Rightarrow x = \frac{-V_{DC}}{\sin a} = -\frac{V_{DC}}{\sin\left[a\tan\left(-\frac{2}{T_{on}} \cdot \sqrt{LC}\right)\right]}$$

(Smaller on time leads to smaller x, the smallest x value being $V_{DC}$)

Finally, $$V_C = -\frac{V_{DC}}{\sin\left[a\tan\left(-\frac{2}{T_{on}} \cdot \sqrt{LC}\right)\right]} \cdot \sin\left[\frac{1}{\sqrt{LC}} t + a\tan\left(-\frac{2}{T_{on}} \cdot \sqrt{LC}\right)\right] + V_{DC}$$

$$V_{c\,\max} = -\frac{V_{DC}}{\sin\left[a\tan\left(-\frac{2}{T_{on}} \cdot \sqrt{LC}\right)\right]} + V_{DC}$$

(Switch stress, the smallest stress equals twice the $V_{DC}$)

$$I_L = -\frac{V_{DC}}{\sin\left[a\tan\left(-\frac{2}{T_{on}} \cdot \sqrt{LC}\right)\right]} \cdot \sqrt{\frac{C}{L}} \cos\left[\frac{1}{\sqrt{LC}} t + a\tan\left(-\frac{2}{T_{on}} \cdot \sqrt{LC}\right)\right]$$

(Inductor current can be changed by changing capacitor and inductor values)

In the equation, L indicates the sum of the leakage inductance with the coupled inductance. $T_{on}$ is the time that capacitor voltage equals zero.

$$T = T_{ON} + T_{OFF} = T_{ON} + 2\pi\sqrt{LC} \cdot \frac{\pi - 2a}{2\pi} = T_{ON} + \sqrt{LC} \cdot \left(\pi - 2 \cdot a\tan\left(-\frac{2}{T_{on}} \cdot \sqrt{LC}\right)\right)$$

A shorter on time leads to a longer off time, and therefore compensates the change of the cycle time.

The situation discussed above assumes the switch is turned on immediately when the capacitor is discharged to zero. However, as long as the inductor current remains negative, the body diode of the switch will be automatically turned on when the capacitor is discharged to zero. The actual switch on time can be different with the calculation.

When the inductor current goes above zero, the diode will be turned off and the capacitor will be charged again, so the switch is turned on before this stage. Assuming the switch is turned on at this time, the switch will then have zero voltage and zero current at turn on. In this case, due to symmetricity, the switch on time will be one half of the actual on time and all the other parameters can then be calculated based on the equations above.

For Ignition

The secondary leakage inductance makes a resonant tank together with the capacitor at the secondary side. By making the secondary resonant tank work near resonance, the impedance of the secondary side is then very low. So most of the voltage is applied to the leakage inductance, and most of the current goes through the transformer.

So basically, taking L to be the leakage inductance, the following equation is applied.

For 1:1 Transformer $$I_{out} = I_{L\,\text{sec}} = I_{L\,pri} = -\frac{V_{DC}}{\sin\left[a\tan\left(-\frac{2}{T_{on}} \cdot \sqrt{L_{leak}C}\right)\right]} \cdot \sqrt{\frac{C}{L_{leak}}} \cos\left[\frac{1}{\sqrt{L_{leak}C}} t + a\tan\left(-\frac{2}{T_{on}} \cdot \sqrt{L_{leak}C}\right)\right]$$

$$V_{out} = I_{out} \cdot \frac{1}{j\omega C} = -\frac{V_{DC}}{\sin\left[a\tan\left(-\frac{2}{T_{on}} \cdot \sqrt{L_{leak}C}\right)\right]} \cdot \cos\left[\frac{1}{\sqrt{L_{leak}C}} t + a\tan\left(-\frac{2}{T_{on}} \cdot \sqrt{L_{leak}C}\right) + \frac{\pi}{2}\right]$$

Notice now $$V_{out} \leq Vc_{max} - V_{DC}$$

That means for a 1:1 transformer, for getting 800 Vpk for ignition, the voltage stress will be already 1.2 kV, and for higher ignition voltage it will be even worse.

For x:1 Transformer $$I_{out} = I_{L\,\text{sec}} = x \cdot I_{L\,pri} = -x \cdot \frac{V_{DC}}{\sin\left[a\tan\left(-\frac{2}{T_{on}} \cdot \sqrt{L_{leak}C}\right)\right]} \cdot \sqrt{\frac{C}{L_{leak}}} \cos\left[\frac{1}{\sqrt{L_{leak}C}} t + a\tan\left(-\frac{2}{T_{on}} \cdot \sqrt{L_{leak}C}\right)\right]$$

$$V_{out} = I_{out} \cdot \frac{1}{j\omega C} = -x \cdot \frac{V_{DC}}{\sin\left[a\tan\left(-\frac{2}{T_{on}} \cdot \sqrt{L_{leak}C}\right)\right]} \cdot \cos\left[\frac{1}{\sqrt{L_{leak}C}} t + a\tan\left(-\frac{2}{T_{on}} \cdot \sqrt{L_{leak}C}\right) + \frac{\pi}{2}\right]$$

This shows that the transformer would boost the output voltage with the same stress on the switch. Assume x=1.5, so when the switch stress is 1.2 kV, the peak output voltage can go up to 1.2 kV now, assuming the DC bus capacitor voltage equals 400V.

For Preheat

By using a higher frequency the output current and voltage can be reduced. Basically a smaller Ton leads to lower primary side current, and a smaller T, which means higher frequency. The secondary resonant tank then works at inductive side and lowers the output voltage. However, as the resonant tank works at inductive side, the equivalent inductance increases. The increase will make the primary side work at a lower frequency according to the same Ton, and set the minimum of the preheat voltage.

The scheme to find out the lowest possible preheat voltage is as follows:

As the lowest primary peak-to-peak voltage equals the switch stress, which is twice VDC at minimum, the secondary minimum peak-to-peak voltage equals 2x times VDC, where x is the transfer ratio of the transformer.

So assuming x=1.5, the minimum peak-to-peak voltage in secondary side will be 1.2 kV. As it's symmetric, the voltage peak is 600V. For getting a 300V peak for ignition, the frequency can then be calculated. For convenience, a graph can be prepared. To draw the graph, pick the T, calculate L in the secondary side, get the equivalent L, then LC is known. And then on time can be calculated. After getting all the T-output/Ton data, the chart can be changed to Ton-output.

Running

After ignition the secondary side becomes a parallel resonant tank. The same method will be used to calculate the Ton-output. By solving a set of equations in a known fashion, the graph can be plotted in Matlab/Mathcad for example.

SUMMARY

The new one-switch topology ballast circuit has the following features:

1. Unique one-switch structure simplifies the circuit and cuts the cost;
2. Soft switching is achieved for the switch all the time;
3. Isolated output stage;
4. No DC blocking capacitor needed;
5. High leakage inductance transformer gives soft start function;
6. Simple control method due to only one switch;
7. Output level is set by selecting frequency, transformer and second resonant tank.

Although the present invention has been described in relation to particular embodiments thereof, many other variations and modifications and other uses will become apparent to those skilled in the art. Therefore, the present invention is not limited by the specific disclosure herein.

What is claimed is:

1. An electronic ballast circuit for delivering power to a load circuit including a fluorescent lamp, comprising:

a DC source;

a first LC tank circuit comprising a first inductor and a first capacitor connected in series across said DC source; and a single semiconductor switch connected in parallel with said first capacitor;

said first inductor being inductively coupled to said load circuit for delivering power to said fluorescent lamp;

a control circuit connected to a control terminal of said switch;

wherein said control circuit turns off said switch near a zero-crossing of said first inductor current.

2. The circuit of claim 1, wherein said load circuit comprises:

a second LC tank circuit comprising a second inductor inductively coupled to said first inductor and a second capacitor connected in parallel with said second inductor; and said fluorescent lamp.

3. The circuit of claim 1, wherein said DC source includes a power factor correction circuit.

4. The circuit of claim 1, wherein said control circuit connected to said semiconductor switch is operable for driving said switch at variable frequencies for operating the lamp in preheat, ignition, and running modes.

5. The circuit of claim 1, wherein said control circuit turns on said switch at a time when current in said first inductor is increasing.

6. The circuit of claim 5, wherein said control circuit includes a circuit for sensing current in said first inductor.

7. The circuit of claim 1, wherein said control circuit turns said switch off and on at times when the voltage on said first capacitor is near zero.

8. The circuit of claim 7, wherein said control circuit includes a circuit for sensing voltage on said first capacitor.

9. The circuit of claim 1, wherein said first and second inductors arc comprised in a transformer, thereby isolating said load circuit.

10. A method of operating an electronic ballast circuit for delivering power to a load circuit including a fluorescent lamp, said ballast circuit comprising: a DC source; a first LC tank circuit comprising a first inductor and a first capacitor connected in series across said DC source; a single semiconductor switch connected in parallel with said first capacitor; mid a control circuit connected for driving said switch; said first, inductor being inductively coupled to said load circuit for delivering power to said fluorescent lamp; said method comprising the steps of:

driving said switch with said control circuit;

wherein said control circuit turns off said switch near a zero-crossing of said first inductor current.

11. The method of claim 10, further comprising the step of providing said load circuit as a second LC tank circuit comprising a second inductor inductively coupled to said first inductor and a second capacitor connected in parallel with said second inductor; and said fluorescent lamp.

12. The method of claim 11, further comprising the step of providing said first and second inductors as a transformer, thereby isolating said load circuit.

13. The method of claim 10, further comprising the step of carrying out power factor correction on supplied AC power for providing said DC source.

14. The method of claim 10, further comprising the step of turning on said switch at a time when current in said first inductor is increasing.

15. The method of claim 14, further comprising the step of sensing current in said first inductor.

16. The method of claim 10, further comprising the step of turning said switch off and on at times when the voltage on said first capacitor is near zero.

17. The method of claim 16, further comprising the step of sensing the voltage on said first capacitor.

18. The method of claim 10, further comprising driving said switch with said control circuit at variable frequencies for operating the lamp in at least one of preheat, ignition, and running modes.

* * * * *